US005630752A

United States Patent [19]

Gubash

[11] Patent Number: 5,630,752

[45] Date of Patent: May 20, 1997

[54] LOW PROFILE AIR VENT FOR SLANTED ROOF

[76] Inventor: Peter J. Gubash, 903 N. Dale St., St. Paul, Minn. 55103

[21] Appl. No.: 570,082

[22] Filed: Dec. 11, 1995

[51] Int. Cl.[6] ..... F24F 7/02

[52] U.S. Cl. ..... 454/366; 52/199

[58] Field of Search ..... 454/366, 367; 52/198, 199

[56] References Cited

U.S. PATENT DOCUMENTS

| | | | |
|---|---|---|---|
| 2,447,472 | 8/1948 | Donley | 454/366 |
| 3,083,633 | 4/1963 | Hochberg | 454/366 |
| 3,828,494 | 8/1974 | Uhrhane et al. | 52/199 X |
| 3,895,467 | 7/1975 | Clement | 52/199 |
| 5,050,489 | 9/1991 | Mankowski | 454/366 X |
| 5,402,611 | 4/1995 | Vagedes | 454/366 X |

FOREIGN PATENT DOCUMENTS

| | | | |
|---|---|---|---|
| 7614608 | 7/1978 | Netherlands | 52/199 |
| 2027469 | 2/1980 | United Kingdom | 52/199 |

*Primary Examiner*—Harold Joyce
*Attorney, Agent, or Firm*—Jacobson and Johnson

[57] ABSTRACT

A single sheet of relatively stiff material is formed with a flat rim surrounding a raised area except along one open side or edge with the raised area having a low elevation so as to present a low profile when placed on the roof and is in air communication with an opening through the roof with the open edge providing an opening for air passage to the atmosphere and having a baffle at the open edge to prevent foreign materials and rain from entering and having tabs at the open edge for grasping the edge of a covering roof shingle. Preferably the vent is triangular in top plan so that the apex angle of the vent opposite the open edge can be easily inserted under a shingle between the nails which hold the shingle in place.

3 Claims, 2 Drawing Sheets

18
26
23
12
11
15
26
22
10

11

12
25
13
15
21
23
18

17
16
16
16
15
14
24
10

5
5
15
23
22
24
24
21
13
14
14
16
16
10
16
16
17

10
14
15
14
23
22
21

LOW PROFILE AIR VENT FOR SLANTED ROOF

FIELD OF THE INVENTION

This invention is for the conventional purpose of providing ventilation to the outside atmosphere through an opening in a slanted roof.

DESCRIPTION OF THE PRIOR ART

The prior art in part is exemplified by the traditional and conventional vents which are commonplace on homes and other buildings having slanted roofs. Typical prior art patents illustrating prior art slant roof ventilators are U.S. Pat. No. 2,551,223 by Schneider and U.S. Pat. No. 2,490,220 by Leslie. Typically and conventionally these are metal devices which have a chamber which is in air communication with an opening through the roof and is slanted downward from the opening with an edge or side of the chamber being open to the atmosphere to establish the air communication link between the outside atmosphere and the hole through the roof. The open side or edge is suitably covered with a screen or the like to allow the air to pass through but yet preventing foreign objects and wind-driven rain from entering into the chamber and reaching the opening through the roof. Typically these conventional air vents are unsightly since they interrupt the slant of the roof line with a large upward angle from the flat surface of the roof. The roof shingles cannot cover over the vents so they protrude somewhat grotesquely out of the plane of the roof and detract from the appearance.

SUMMARY OF THE INVENTION

The instant invention is similar in purpose and function as prior art roof vents. The vent has a raised area which forms a chamber covering over an opening through the roof and has a lower edge or side which is open to the atmosphere. The raised area has a low elevation so it makes a very small upward angle with respect to the flat surface of the roof so that it has a low profile or silhouette and can be and is covered over by the roof shingles so is not as unsightly as the more conventional roof vents. Tabs are provided at the open edge of the vent to grasp the edge of the covering shingle to hold it in place. The vent is made out of a single sheet of relatively stiff material so it is relatively simple to manufacture and does not have any seams which could leak. Preferably the vent is formed in a triangular shape in plan view. The apex of the vent which is opposite the open edge can be inserted under a shingle between the nails which hold the shingle in place so that the vent can be easily inserted in a shingled roof and rests on the roof along the roof slant.

DESCRIPTION OF THE PREFERRED EMBODIMENTS

Figure 1:
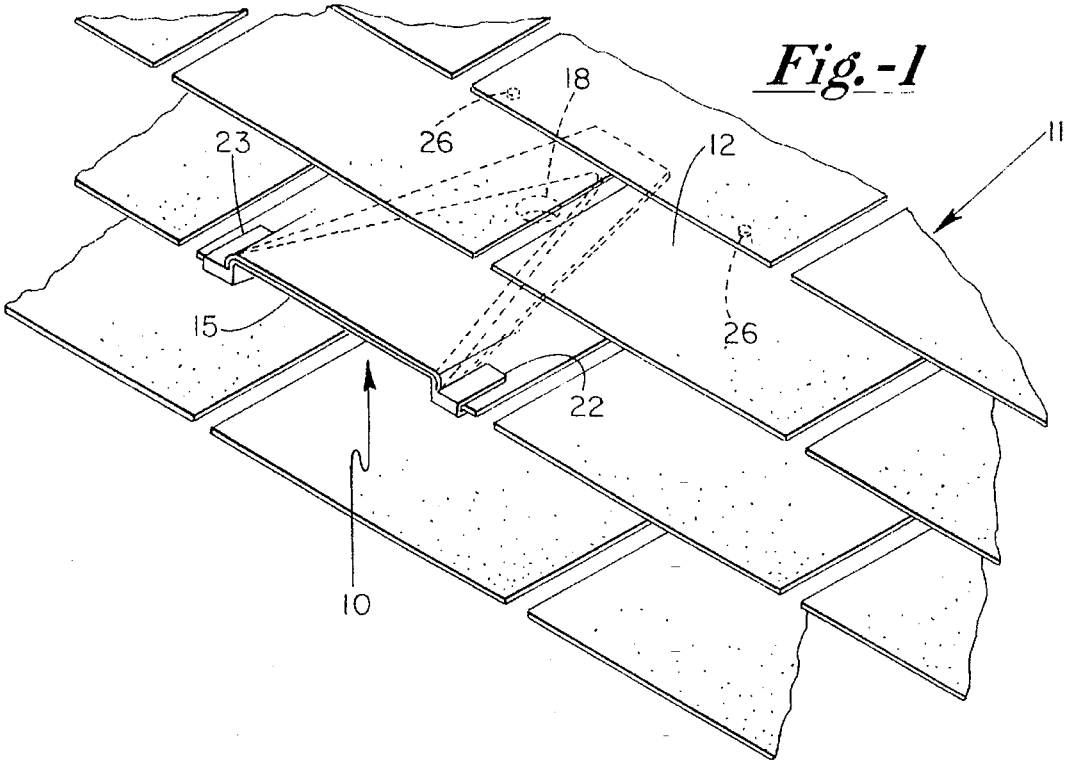
FIG. 1 is a perspective view illustrating a preferred embodiment of the invention when installed on a slanted roof.

As illustrated in FIG. 1 the ventilator 10 is mounted in a conventional fashion on a conventional downwardly slanted roof designated generally by reference numeral 11 with a series of conventional shingles 12 uniformly distributed over the top of the roof as a protective covering. Ventilator 10 is formed out of a single sheet of suitable relatively stiff material, e.g., a sheet of metal or a sheet of plastic, which is suitably or conventionally die pressed or molded to form a chamber 13 enclosed by low sidewalls 14 and open along one edge or side 15. Extending outward from the bottom edge of sidewalls 14 is a flat rim 16. The preferred embodiment of the ventilator is triangular in top plan view. The apex 17 of the triangle is at the upper end and the open side 15 of chamber 13 is the bottom of the ventilator when it is in position on the roof.

Figure 2:
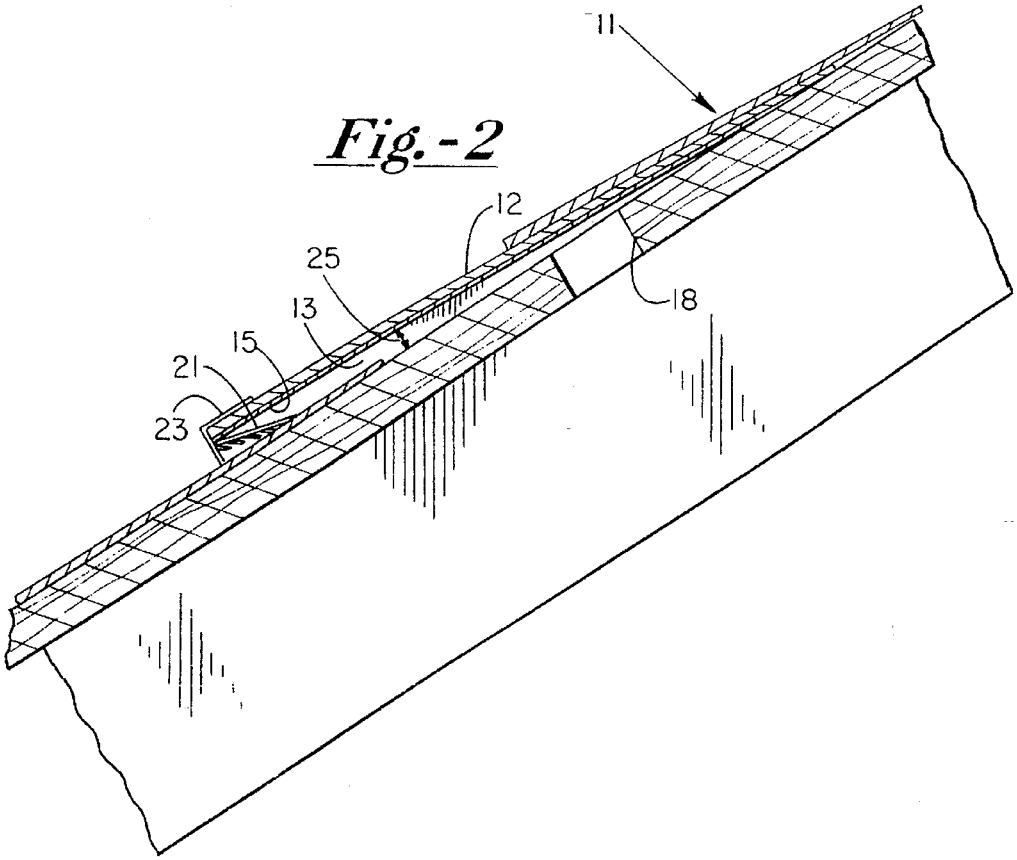
FIG. 2 is a side sectioned view of FIG. 1.
Figure 3:
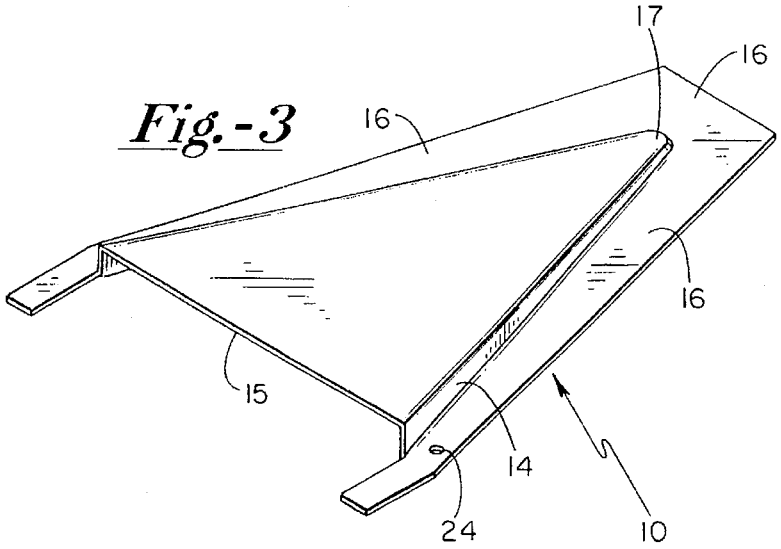
FIG. 3 is a perspective view of the preferred embodiment of the invention.
Figure 4:
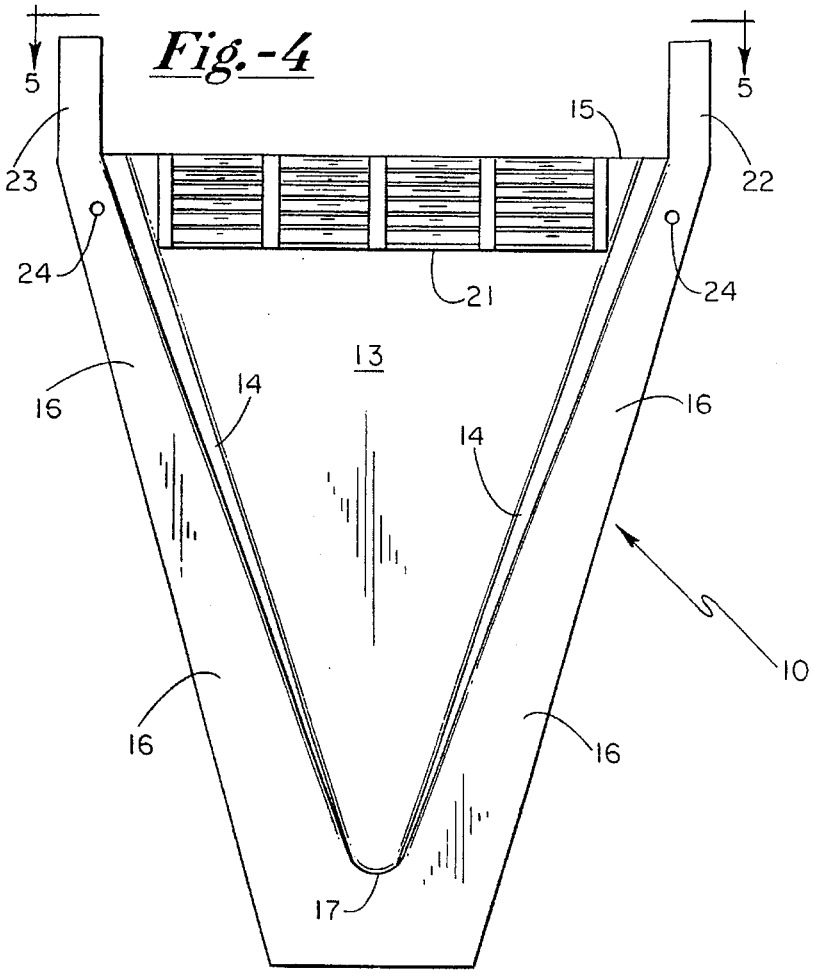
FIG. 4 is a view from the underside.
Figure 5:
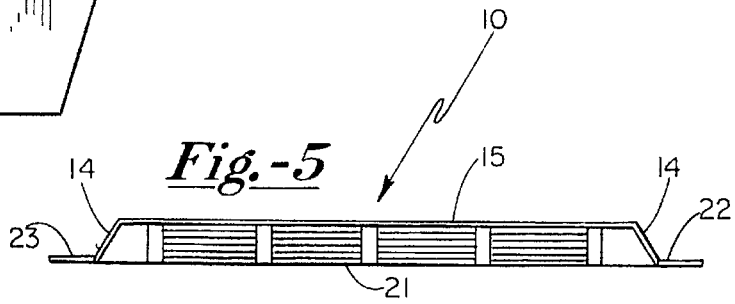
FIG. 5 is an end view.

In use, initially an air ventilating hole or opening 18 is made through the roof material, which may be plywood or some other suitable material covered over with tarpaper or the like. The ventilator 10 of the instant invention is placed so that chamber 13 is in air communication with hole 18 with the top angle or apex 17 of the ventilator under overlapping shingles 12 as illustrated in FIGS. 1 and 2. The apex 17 of the ventilator can be slid or positioned between nails, not shown, which hold the overlapping shingles in place. The open side 15 of vent 10 then provides the opening to the outside atmosphere for venting the air through opening 18. The open edge 15 is covered with a baffle or suitable foraminous material 21 which is arranged to prevent foreign material or articles or wind-driven rain from entering into chamber 13 and finding its way into air vent opening 18. A set of tabs 22 and 23 located at the outer ends of open side 15 are bent over the edge of a covering shingle 12 to hold it in place over the vent.

Because vent 10 is made out of a single sheet of material, there are no seams which could provide openings for leakage of moisture. Because the chamber is formed by low sidewalls, the vent has a low profile or silhouette so does not make the roof line as unsightly as has been the case in the past with the more conventional and traditional roof vents.

Openings 24 for nails or other securing devices may be provided through rim 16 to assist in holding the vent in place after it is installed on the roof.

The vent is placed on the roof so that the chamber 13 is over the roof opening 18 and the bottom edge or side 15 of the vent is generally in line with the bottom edge of a covering shingle 12 so tabs 22 and 23 hold the shingle in place.

In order to maintain the low profile feature and yet provide adequate venting, the angle of elevation that the top of chamber 13 makes with respect to the surface defined by rim 16, as denoted by arc 25 in FIG. 2, is to some degree a matter of choice. For example, the opening at edge 15 will have a height of about five-eighths of an inch if the angle is about two degrees and the length of the vent, from apex 17 to edge 15, is about eighteen inches or if the angle is about four degrees and the vent length is about twelve inches. So the dimensions may vary depending upon what the user decides is acceptable as a height for the open edge of the vent. Preferably the height of the opening at edge 15 should be in the range from about five-eighths of an inch to about two inches and the length of the vent should be such that the open edge 15 generally coincides with the lower edge of the coveting shingle 12 while the apex or top edge of the vent is in line with the fasteners or nails 26 which hold the covering shingle in place.

As a further feature, tabs 22 and 23 engage the bottom edge of the covering shingle 12 in a fashion to cause the edge of the shingle to bow or bend outward so that any water coming down over the shingle will flow sideways away from the opening at 15 instead of directly over it thereby lessening the likelihood of the water reaching the roof opening 18.

I claim:

1. For a slanted shingled roof having a ventilating opening, a low profile ventilator, comprising:

a single sheet of generally triangular substantially stiff material formed into a raised area defining a low profile chamber which is open at one edge only and closed along the other edges by low side walls with a flat rim extending around the bottom edges of said side walls, said rim resting against the roof so that said chamber is above and in air communication with the roof ventilating opening and slanted downward along the roof toward said open edge from the ventilating opening;

said raised area being uncurved so that the covering shingle lays flat on top of the raised area;

a foraminous screen closing off the open edge of said chamber; and tabs at said open edge for engaging the edge of a roof shingle covering over the ventilator for holding the shingle in place on top of the ventilator.

2. The low profile ventilator as described in claim 1 wherein the height of the opening at the open edge is in the range of about five-eighths inch to about two inches and the open edge generally coincides with the lower edge of a covering shingle and the apex is located between and generally in line with fasteners holding the covering shingle in place.

3. The low profile ventilator as described in claim 2 wherein said tabs engage the edge of the roof shingle to direct the lower edge of the shingle downward and away from the open edge of the ventilator to deflect rain away from the open edge.

* * * * *